US006971965B1

(12) United States Patent
Shishido

(10) Patent No.: US 6,971,965 B1
(45) Date of Patent: Dec. 6, 2005

(54) BALL FOR BALL GAME AND METHOD FOR MANUFACTURING THE SAME

(75) Inventor: Hideomi Shishido, Hiroshima (JP)

(73) Assignees: Molten Corporation, Hiroshima (JP); adidas International Marketing B.V., Amsterdam (NL)

( * ) Notice: Subject to any disclaimer, the term of this patent is extended or adjusted under 35 U.S.C. 154(b) by 0 days.

(21) Appl. No.: 10/275,032

(22) PCT Filed: May 1, 2000

(86) PCT No.: PCT/JP00/02858

§ 371 (c)(1),
(2), (4) Date: Jul. 30, 2003

(87) PCT Pub. No.: WO01/83047

PCT Pub. Date: Nov. 8, 2001

(51) Int. Cl.[7] ..... A63B 39/00
(52) U.S. Cl. ..... 473/604; 473/608
(58) Field of Search ..... 473/603–605, 473/607, 609, 597–599, 600–602

(56) References Cited

U.S. PATENT DOCUMENTS

| | | | | |
|---|---|---|---|---|
| 1,187,029 | A | 6/1916 | Beebout | |
| 1,923,236 | A | 8/1933 | Sonnett | |
| 2,653,818 | A * | 9/1953 | Tebbetts, Jr. et al. | 473/604 |
| 3,119,618 | A | 1/1964 | Molitor et al. | |
| 4,333,648 | A | 6/1982 | Aoyama | |
| 4,660,831 | A | 4/1987 | Kralik | |
| 4,856,781 | A | 8/1989 | Shishido et al. | |
| 5,752,890 | A | 5/1998 | Shishido et al. | |
| 5,759,123 | A | 6/1998 | Ou | |
| 5,772,545 | A | 6/1998 | Ou | |
| 6,099,423 | A | 8/2000 | Ou | |
| 6,206,795 | B1 | 3/2001 | Ou | |
| 6,302,815 | B1 | 10/2001 | Shishido et al. | |

FOREIGN PATENT DOCUMENTS

| | | |
|---|---|---|
| EP | 1 080 745 | 3/2001 |
| JP | 27 3908 | 5/1952 |
| JP | 38 16729 | 8/1963 |
| JP | 08 252341 | 10/1996 |
| JP | 09/019516 | 1/1997 |
| JP | 10 323409 | 3/1998 |

* cited by examiner

*Primary Examiner*—Steven Wong
(74) *Attorney, Agent, or Firm*—Goodwin Procter LLP

(57) ABSTRACT

To provide a ball for ball game and a method for manufacturing the ball having superior sphericity, an ability to retain its original shape, durability, and soft feel. The fabric layer (12) is formed by sewing with a sewing machine for instance pentagonal first fabric pieces (13) together with composite shaped second fabric pieces (14) in which two hexagons are connected with each other, so that a spherical shape is formed. The marginal edge of the first and second fabric pieces are superimposed in the spherical surface direction, so that corner portions thereof are temporarily attached. Temporary attachment is achieved by inserting the needle into the needle through hole formed in the corner of the first and second fabric pieces, and welding by means of ultra sonic wave, such that the first and second fabric pieces (13, 14) are accurately aligned. The temporarily attached fabric pieces sewn together using a sewing machine along the guiding line (17) for sewing printed beforehand on the surface of the fabric pieces (13, 14).

18 Claims, 15 Drawing Sheets

BALL FOR BALL GAME AND METHOD FOR MANUFACTURING THE SAME

TECHNICAL FIELD

The present invention relates to a ball for ball game and method for manufacturing the ball for ball game particularly for such games as soccer, handball and volleyball.

BACKGROUND ART

Conventionally, an air-inflated ball manufactured for the ball sports comprises a rubber bladder for containment of air, a reinforcing layer formed around the bladder for rendering the ball spherical and durable, and a skin layer made of a plurality of leather panels bonded to the reinforcing layer. The reinforcing layer is typically made of twelve generally trapezoidal pieces of fabric each having outer edges sewn with another to form a generally spherical shape (Japanese Unexamined Patent Publication No. 236568/1987).

FIGS. 14 and 15 show the structure disclosed in the Gazette mentioned above. Specifically, a generally trapezoidal piece of fabric 1 is paired with another and sewn to each other in mirror symmetry to form an equilateral quadrilateral 2. A total of six equilateral quadrilaterals 2 are arranged and sewn into a generally spherical shape in such a pattern that a pair of adjacent equilateral quadrilaterals have respective center joined portion 3 perpendicular to each other. The fabric piece 1 has a perimeter portion folded inwardly by 180 degrees, with an abutting portion sewn to the adjacent fabric piece with a thread 5. A member indicated by numeral 6 is a bladder held inside the reinforcing layer 4, and an arrow "a" shows a direction in which a warp runs.

DISCLOSURE OF INVENTION

In the above-mentioned prior art documents, two fabric pieces 1, 1 are first superimposed with each other and then sewn together using a sewing machine. However, with this method there is the possibility that the sewing line is not constantly formed. Furthermore, the fabric pieces are folded inside out after the fabric pieces have been sewn together. For this reason, the more the sewing work advances, the more difficult and complex the sewing work becomes. Due to the difficult sewing work, the resulting reinforcing fabric layer does not have the desired properties of sphericity and durability.

Further, in the document described above, not only the reinforcing layer must be sewn into the sphere but also there must be an aperture left at the end of the sewing for inserting the bladder 6. After inserting the bladder 6 from this aperture, the aperture must be closed by sewing (commonly referred to as "finish sewing.") Conventionally, a finish sewing portion 7 (FIG. 14) must unavoidably be folded outwardly for the sewing, being a cause of an irregularity in the ball surface. The finish portions are sewn together by hand sewing instead of with a sewing machine, so that the construction in which the finish portions are folded inside can be obtained in the same way as with the other sewn portions. Thus, tensile strength in the finish sewing portion is different from the tensile strength in the other sewn portions (it is weaker), thereby causing the reinforcing layer to be deformed in shape, and causing a difference of elastic property for restitution. Further, hand sewing is very laborious and trouble some, and it takes much time for hand sewing.

The present invention is directed to a ball including a bladder, a fabric layer around the bladder, and an outer skin layer made of a plurality of panels, wherein the fabric layer is formed of fabric pieces whose marginal edges are superimposed, and sewn together. With the above mentioned arrangement, the fabric pieces are sewn together such that the edges of the fabric pieces are superimposed and the tensile strength of the fabric pieces are constantly maintained by a sewing machine. Furthermore, there is no need to turn the two fabric pieces inside out once they have been sewn together. Therefore, sewing work using the sewing machine might not become difficult even if the number of the fabric piece is increased.

According to one embodiment of the invention, the pieces of the fabric layer are pentagons or hexagons or a composite shape made up of pentagons or hexagons or both. With the above-mentioned arrangement, a semi-32hedral composed of twenty pieces of hexagons and twelve pieces of pentagons can be constructed, and each face is curved outside, so that a spherical body can be obtained.

According to one embodiment of the invention, the pieces of the fabric layer are triangles or pentagons or a composite shape made up of triangles or pentagons or both. With the above-mentioned arrangement, a semi-32hedral composed of twenty pieces of triangles and twelve pieces of pentagons can be constructed, and each face is curved outside, so that a spherical body can be obtained.

According to one embodiment of the invention, the fabric layer is formed of a laminate of two woven fabrics arranged such that the warp of the one fabric is perpendicular to that of the other. In the single fabric piece, the tensile strength of the fabric piece in the warp direction is different from that in the weft direction. Normally, the tensile strength in the warp direction is larger than that in the weft direction. With the above-mentioned arrangement, the tensile strength of the fabric piece in the warp direction is substantially the same as that in the weft direction by superimposing two fabric pieces.

According to one embodiment of the invention, the positioning of the joined portion in the fabric layer corresponds, or substantially corresponds with the positioning of the joined portion of the panels in the outer skin layer. With the above arrangement, the joined portion of the panels in the outer skin layer is positioned on the seaming line of the two fabric pieces having a greater bonding strength due to the overlapping edge portions of the fabric pieces. Therefore, an aperture cannot appear between any one of the panels and the other one of the panels adjacent thereto, and a close contact between the two adjacent panels can be maintained.

According to one embodiment of the invention, the shape of the pieces in the fabric layer is the same or substantially the same as the shape of a single panel of the outer skin layer, or of two panels of the outer skin layer. With the above arrangement, the joined portion of the pieces in the outer skin layer is positioned on the seaming line of the two fabric pieces having a greater bonding strength due to the overlapping edge portions of the fabric pieces. Therefore, an aperture cannot appear between any one of the panels and the other one of the panels adjacent thereto, and a close contact between the two adjacent panels can be maintained.

According to one embodiment of the invention, at least one fabric piece has a center line and a warp or a weft line which corresponds with one of three reference circles on a spherical surface of the fabric layer, any one of said three reference circles being perpendicular to the other two reference circles. With the above arrangement, by the three reference circles, the spherical surface is evenly divided.

Therefore, tensile strength of the warp or the weft line of the fabric piece positioned on the reference circle is evenly applied to the spherical surface, and serves as a force for maintaining a spherical shape.

According to one embodiment of the invention, the fabric layer includes a first fabric piece arranged in such a manner that the warp or the weft line is formed along one of three reference circles and a second fabric piece arranged in the center of a triangular region formed by the three reference circles. With the above arrangement, tensile strength of the warp or the weft line is evenly applied to the spherical surface, and serves as a force for maintaining a spherical shape. The pressure applied to the fabric layer from the bladder or the impact load applied from the outside is evenly dispersed across the fabric layer, and the sphericity is maintained even if the pressure is iteratively applied to the fabric layer for a long interval. The second fabric piece is positioned in the center of the triangular region formed by the reference circles, and surrounded by the first fabric piece to be sewn together. The pressure applied to the second fabric piece is dispersed to the first fabric piece. A fabric layer covering the whole surface of the bladder is formed from first and second fabric pieces.

According to one embodiment of the invention, the fabric layer is made by first attaching the fabric pieces by bonding to form a temporary attachment, and then sewing them together. With the arrangement, the edge portions of the fabric pieces are superimposed, and two adjacent fabric pieces are accurately aligned by temporary attachment, so as to enable the fabric pieces to be sewn together with even tensile strength by a sewing machine. The sewing work using a sewing machine cannot become troublesome even if the number of the fabric pieces sewn together is increased.

According to one embodiment of the invention, the fabric pieces are sewn together along a guiding line for sewing formed on the fabric pieces by printing. With the above arrangement, the fabric pieces are sewn along the guiding line by the worker, so that the fabric pieces can be accurately and easily sewn together.

According to one embodiment of the invention, the fabric pieces are sewn together in such a manner that two sewing lines parallel to each other are formed. With the above arrangement, the two fabric pieces sewn together have a tensile strength twice as great as fabric pieces which are sewn together in such a manner that single sewing line is formed.

According to one embodiment of the invention, the fabric pieces are bonded together by applying latex adhesive, the temporary attachment is undergone by melting latex adhesive using ultrasonic wave. With the above arrangement, marginal edges of two fabric pieces are superimposed and partially subjected to ultrasonic wave. Thereby, latex adhesive is heated and melted welding the two fabric pieces together.

According to one embodiment of the invention, the method includes steps of forming a spherical fabric layer by sewing the fabric pieces together by a sewing machine in such a manner as to allow an aperture not to be sewn together, the aperture serving as a hole for inserting the bladder. Then forming a penetrating hole for inserting a needle through the fabric layer,) inserting the bladder into the spherical fabric layer and closing the aperture for inserting the bladder by sewing the fabric layer via the penetrating hole using the sewing machine. With the above arrangement, the bladder insertion aperture is sewn up by using the needle through hole. Therefore, the aperture can be sewn by sewing machine exactly into the same structure as with the other sewn portions.

According to one embodiment of the invention, the needle through hole may be a hole for a valve for injection of the air into the bladder. With the above arrangement, there is no particular need for providing a hole specifically for the finish sewing.

BEST MODE FOR CARRING OUT THE INVENTION

Embodiment 1

Figure 1:
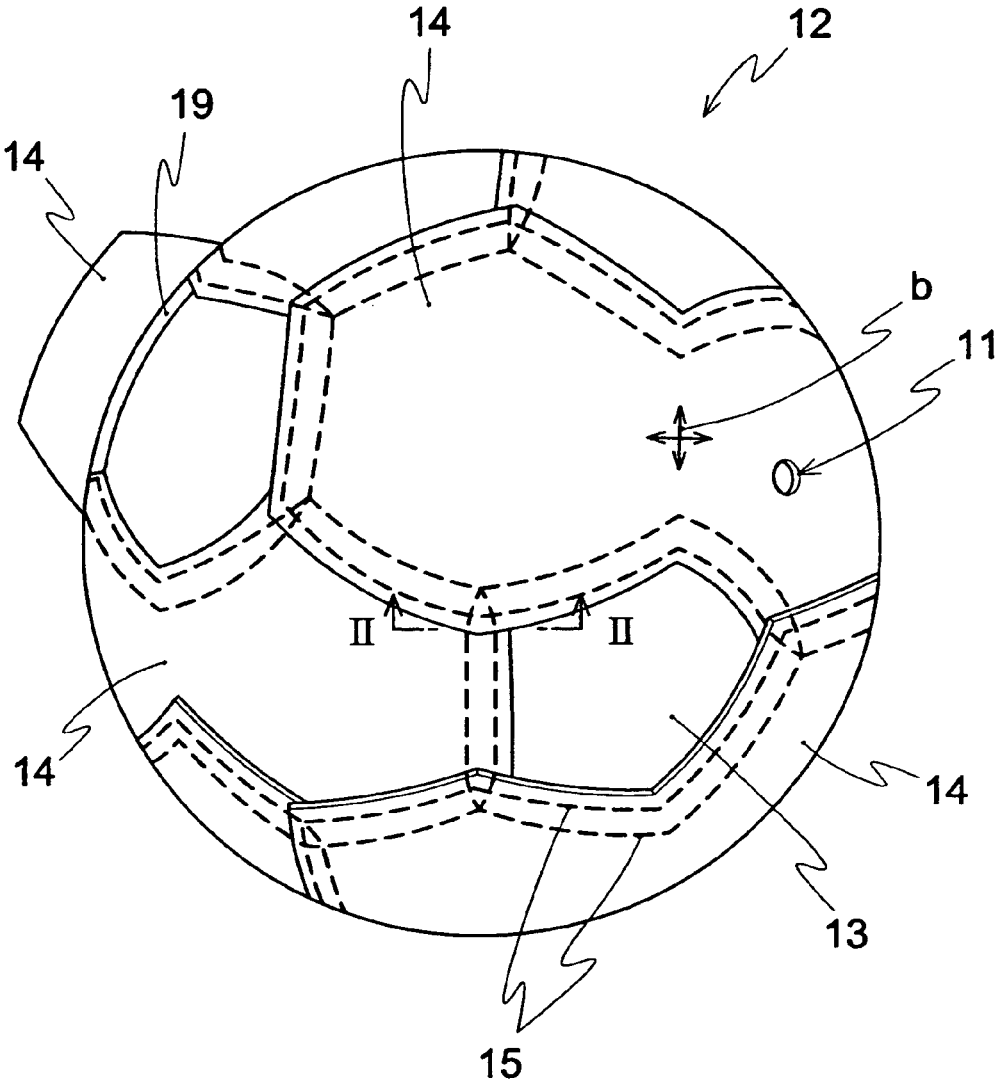
FIG. 1 is a front view showing a fabric layer of the ball for ball game of the EMBODIMENT 1 of the present invention.
Figure 2:
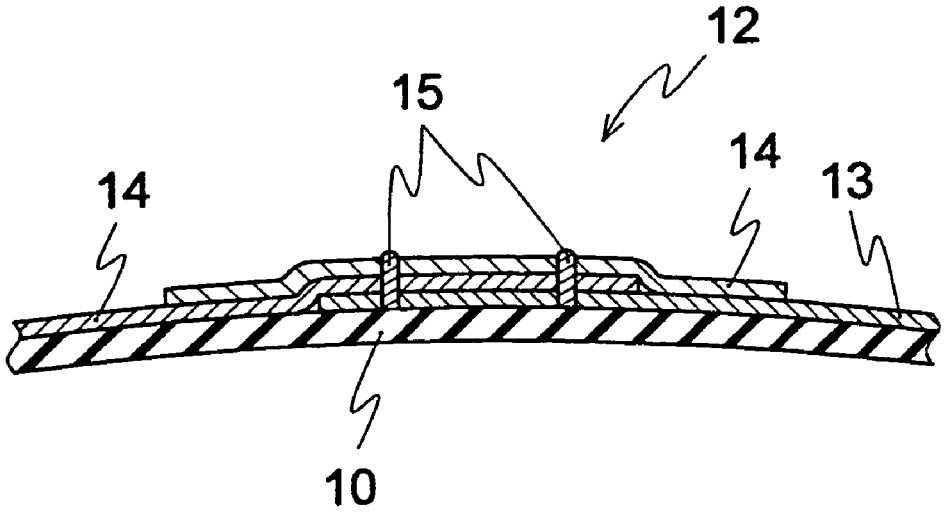
FIG. 2 is cross sectional view taken on line II—II of FIG. 1.
Figure 3:
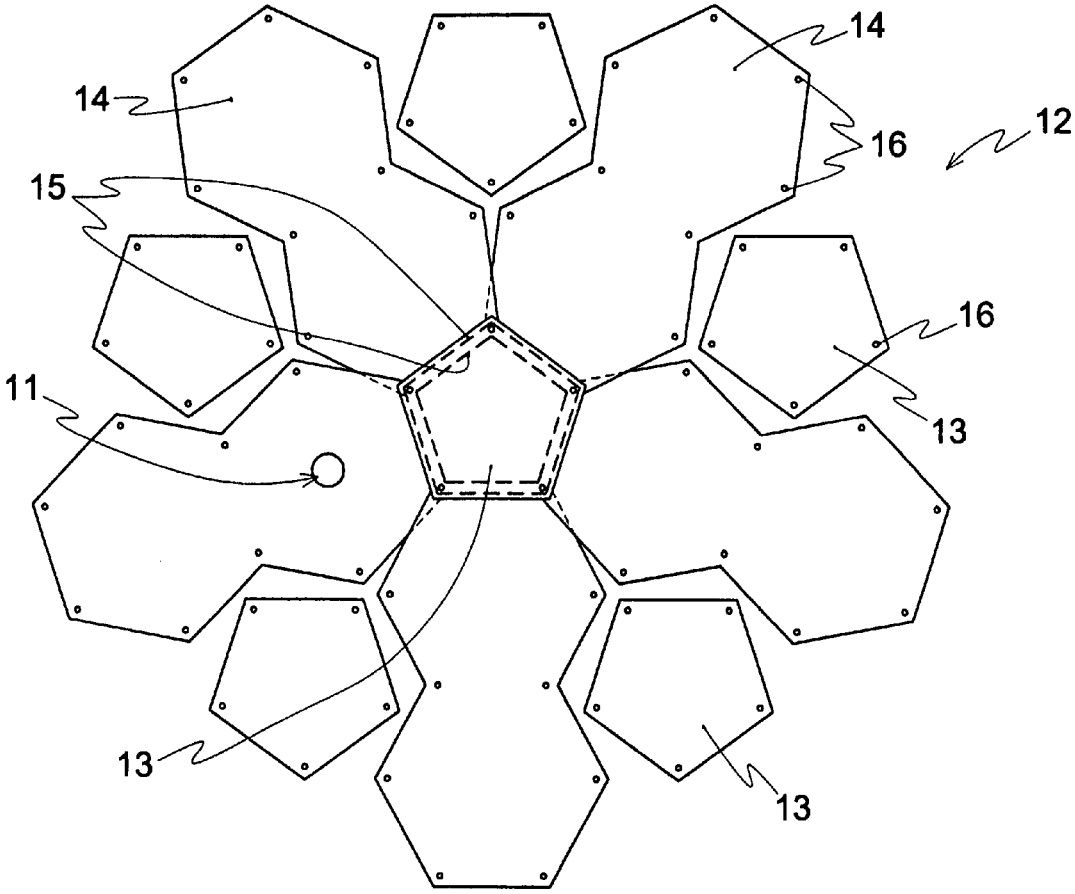
FIG. 3 is a plan view illustrating how to sew pieces of a first and a second woven fabric.

Hereinafter, EMBODIMENT 1 of the present invention, that is an application of the present invention to a soccer ball will be described with reference to the drawings. Referring to FIGS. 1 through 3, a member indicated by numeral 10 is a bladder having a spherical hollow body, made of a non-air-permeable elastic material such as butyl rubber. The bladder contains compressed air. A member indicated by numeral 11 is a valve hole. Inside this valve hole 11, a valve (not illustrated) is provided, and the compressed air is injected into the bladder 10 via the valve 11 to an inner air pressure of about 1.0 kg/cm$^2$.

A member indicated by numeral 12 is a woven fabric layer (hereinafter referred to as "fabric layer") formed to cover a surface of the bladder 10, made of a plurality of fabric pieces (hereinafter referred to as "fabric pieces") formed into a sphere, serving as a reinforcing layer. The fabric pieces include twelve pentagonal pieces of first fabric pieces 13, and ten hexagonal pieces of second fabric pieces 14 each shaped like a pair of hexagons sharing a side. These pentagons and hexagons, including twelve pentagons and twenty hexagons, generally correspond to a semi-regular dotriacontahedron that will cover the surface of the bladder 10, and are made slightly larger than those pentagons and hexagons actually constituting the semi-regular dotriacontahedron for the sake of bonding with adjacent pieces.

Each of the first and second fabric pieces 13, 14 is made of two pieces of a flat-woven cloth bonded to each other in lamination with an adhesive such as latex, so that the warp in one piece runs perpendicular to the warp in the other. Further, the warp and the weft have the same tensile strength. Specifically, in a common flat-woven cloth, the warp has a greater tensile strength than the weft. If the tensile strength is different in the two directions, the weft is stretched more quickly, causing deformation. Further, one of the fine lines (the warp running direction, and the weft running direction perpendicular to the warp running direction; indicated by an arrow "b" in FIG. 1) is aligned with a longitudinal axis of the second fabric piece 14. Each of the first and second fabric pieces 13, 14 can be stretched more easily in directions 45 degrees off the fine line (bias effect), absorbing and relieving impact exerted to the ball in these directions. The first and second fabric pieces 13, 14 can be made of a cotton cloth or a cotton-polyester cloth.

As shown in FIG. 3, the first and second fabric pieces 13, 14 are arranged like flower petals. Specifically, one of the first fabric pieces 13 placed as a center has each of its sides overlapped by one of the second fabric pieces 14 and sewn together by a thread 15. Then, the other first fabric pieces 13 are placed between the five petals of the second fabric pieces 14 and sewn to each of the adjacent second fabric pieces 14, completing a half portion of the sphere.

When the first and second fabric pieces 13, 14 are sewn to each other, first, a pinhole 16 is formed in each corner portion of the first and second fabric pieces 13, 14. Then, margins of two or three mutually adjacent first and second fabric pieces 13, 14 are overlapped with each other so that the corresponding pinholes come in alignment and are penetrated by a needle (not illustrated). This establishes positioning of the pieces. Under this state, a portion around each of the pinholes 16 is bonded by ultrasonic melting. Specifically, the latex adhesive applied to the first and second fabric pieces 13, 14 is melted by the ultrasonic wave, bonding the first and second fabric pieces 13, 14 together. The first and second fabric pieces 13, 14 thus bonded temporarily at the corner portions, are then sewn to each other by a sewing machine. The pinholes 16 are formed at the same time as when the first and second fabric pieces 13, 14 are cut. Alternatively, even in the case the pinholes are not formed, at the time when the lines for sewing are printed, a mark may be printed on the fabric pieces to enable an accurate alignment of the first and second fabric pieces 13, 14 once the first and second fabric pieces 13, 14 are accurately aligned by reference to the printed mark, the mark is penetrated by a needle to secure positioning of the pieces and the pieces are then welded by ultrasonic wave. It should be noted here that the temporary bonding or provisional sewing may alternatively be made by using an adhesive instead of the ultrasonic bonding.

Figure 4:
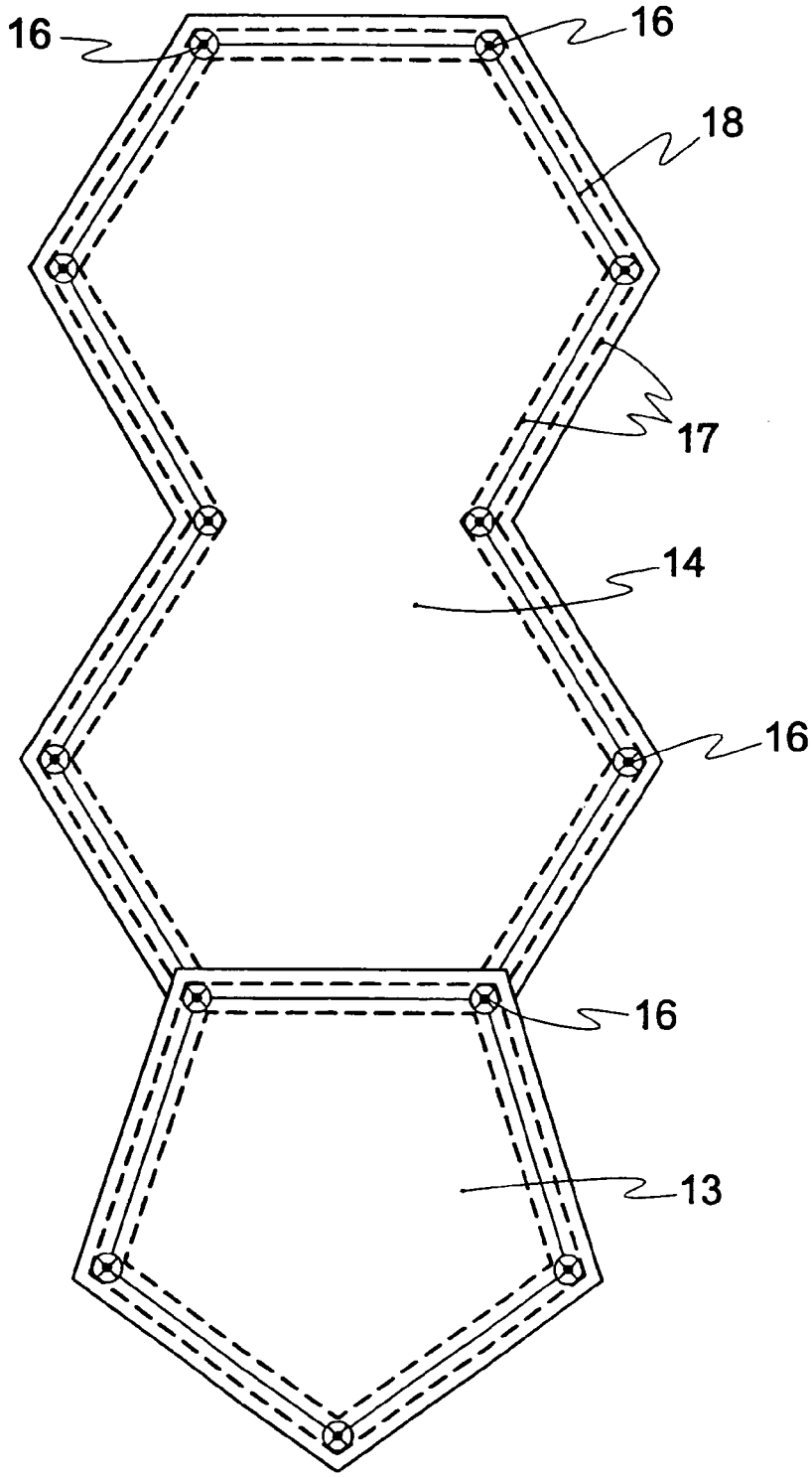
FIG. 4 is a plan view illustrating how to sew pieces of a first and a second woven fabric.

As shown in FIG. 4, the first and second fabric pieces 13, 14 are machine sewn along a guiding line 17 printed in advance on the surface of each piece. The sewing is made in two parallel lines, and therefore two guiding lines 17 are provided. A line 18 indicated by a solid line between the two guiding lines 17 is a centerline indicating a center between the guiding lines 17. By providing the two sewing lines, the fabric pieces 13, 14 are bonded more strongly. The number of sewing lines may be increased if greater strength is needed. The machine sewing thread 15 of No. 5 can be used. The hemisphere portion of the fabric layer 12 thus completed is then sewn to the other hemisphere portion prepared in the same method as described above, thereby forming a spherical fabric layer 12.

Referring to FIG. 3, the member indicated by numeral 11 is the valve hole formed in one of the hexagon portions of one of the second fabric pieces 14. The valve hole is located at the valve portion of the bladder 10. When the first and second fabric pieces 13, 14 are sewn to each other, several sides away from the valve hole 11 are not sewn, thus providing a bladder inserting aperture 19, into which the bladder 10 is inserted into the fabric layer 12.

Figure 5:
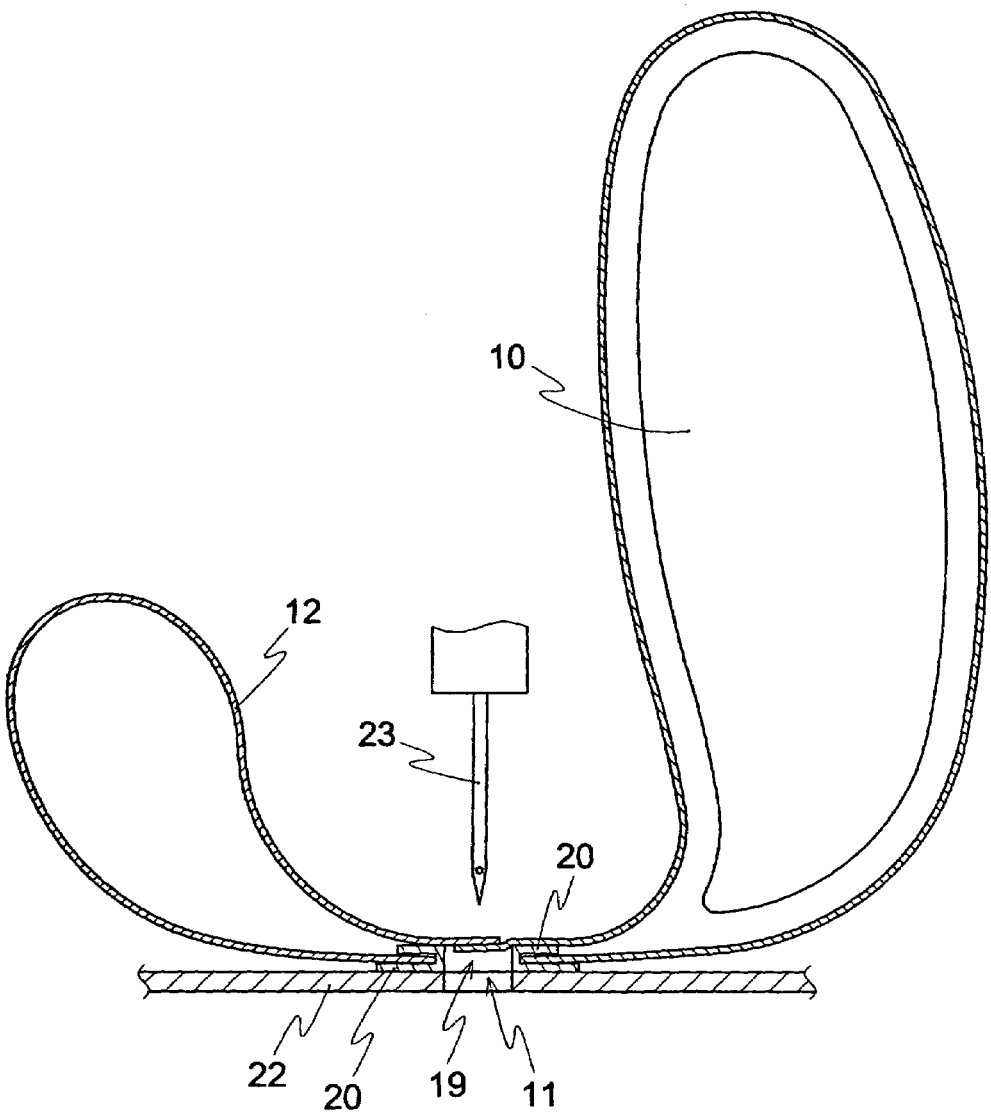
FIG. 5 is a sectional view illustrating a finish sewing of the reinforcing layer.
Figure 6:
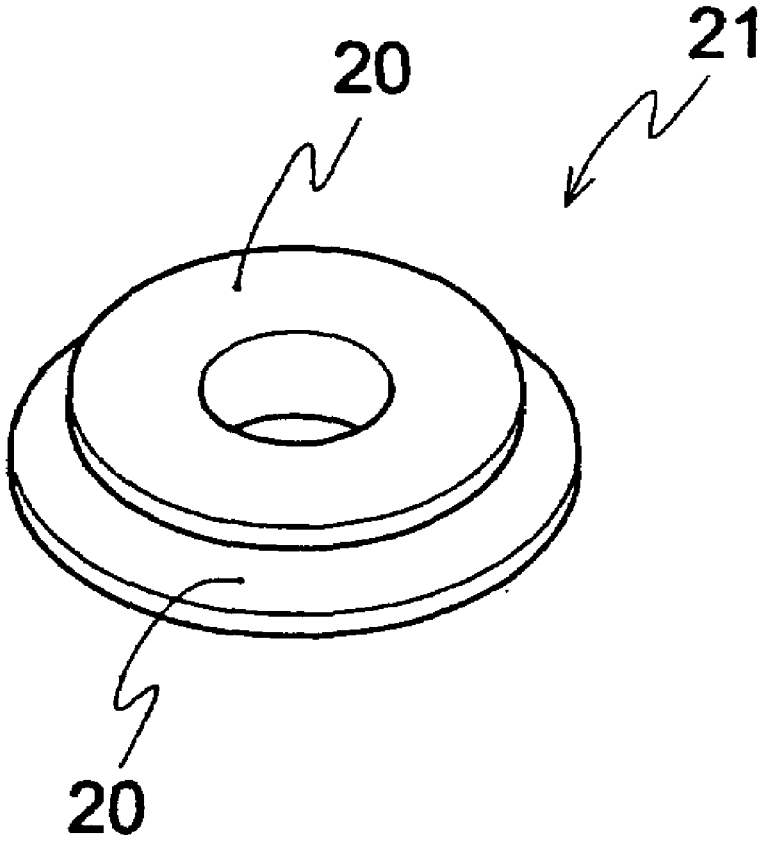
FIG. 6 is a perspective view showing a fixing hardware.

As shown in FIG. 5, after the bladder 10 is inserted, the valve hole 11 of the fabric layer 12 is engaged with a cylindrical fixing hardware 21 (FIG. 6) which is fixedly located under the sewing needle 23 on a sewing table 22, said fixing hardware having two ends provided with flange portions 20, 20 respectively. The cylindrical portion of the fixing metal 21 has an outer diameter generally equal to a diameter of the valve hole 11. The flange portions 20 flank the upper and lower surfaces of the fabric layer, thereby fixing a portion around the valve hole 11 of the fabric layer 12 right beneath the sewing needle 23. Under this state, the portion around the inserting aperture 19 of the fabric layer 12 is placed right beneath the sewing needle 23, and the inserting aperture 19 is closed by machine sewing. During this operation, the bladder 10 is gathered and held on one side within the fabric layer 12. By such finish sewing as described above, the fabric layer 12 becomes a closed sphere. It should be noted here that the valve hole 11 is used as a needle through hole according to the above arrangement. Alternatively, an independent needle through hole may be formed separately from the valve hole 11. However, formation of the independent needle through hole reduces the strength of the hole portion in the fabric layer 12, as well as altering impact resilience, adversely affecting key characteristics of the ball. Therefore, use of the valve hole 11 is more preferable.

Figure 7:
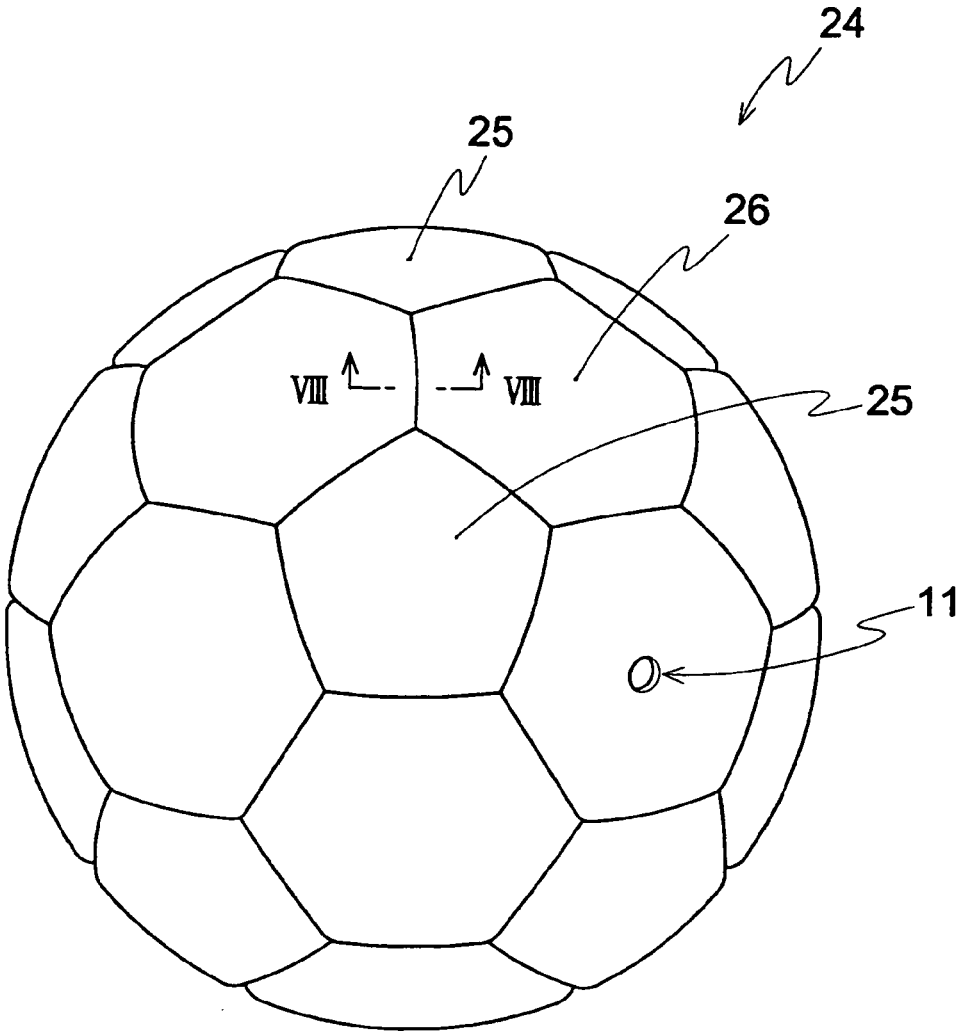
FIG. 7 is a front view showing outline shape of the ball for ball game of the EMBODIMENT 1 of the present invention.
Figure 8:
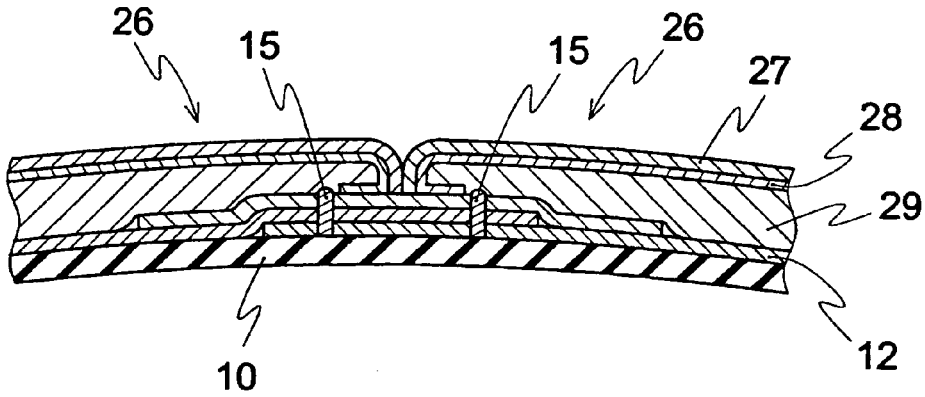
FIG. 8 is a cross sectional view taken along line VIII—VIII of FIG. 7.

Referring now to FIGS. 7 and 8, numeral 24 indicates a skin layer including twelve pentagonal leather panels 25 and twenty hexagonal leather panels 26 which are adhered on the fabric layer by means of adhesive made of CR or natural rubber. These thirty-two leather panels cover the entire surface of the fabric layer 12. The leather panel can be made of synthetic or natural leather. As has been mentioned earlier, the skin layer 24 made of the thirty-two leather panels is like a semi-regular dotriacontahedron which is a kind of polyhedron. Specifically, the skin layer is a semi-regular dotriacontahedron slightly swelled outwardly into a sphere-like form. It is desired that each of the pentagonal leather panels 25 and the hexagonal leather panels 26 is placed correspondingly onto one of the pentagons or hexagons made of the first and second fabric pieces 13, 14. By such construction, the warp and the weft line of the the first and second fabric piece 13, 14 have a high tensile strength which prevents the joined portion of the leather panels 25, 26 from opening, the irregularity of the sewing line in the first and second fabric pieces 13, 14 can be prevented from generating on the leather panels 25, 26. However, the ball which has no practical problem can be obtained even in the case that the pattern of the leather panels 25, 26 is different from that of the fabric layer 12. It should be noted here that a cover rubber layer may be interposed between the fabric layer 12 and the surface layer 24 for enhanced bonding between the two layers.

Each of the leather panels 25, 26 includes a top layer 27 made of leather or synthetic leather, which is backed by a panel fabric layer 28 and the buffer layer 29 made of a foam material for example. The top layer 27 is folded inwardly in such a manner that the end or terminal portion of the top layer 27 might plot almost a quarter of a circle (in other words the marginal edge might turn by about 90 degrees). Meanwhile, the panel fabric layer 28 is folded inwardly in such a manner that the end of the panel fabric layer 28 might plot almost a half of a circle (in other words the marginal edge might turn by about 180 degrees) while holding buffer layer 29 within the inwardly folded panel fabric layer 28. The top layer 27, the panel fabric layer 28 and the buffer layer 29 are bonded to each other by for example latex. The end of the top layer 27, the folded part of the panel fabric layer 28 and the inner side the buffer layer 29 are bonded to the fabric layer 12. By virtue of such a construction that the panel fabric layer 28 is folded inwardly in such a manner that the end of the panel fabric layer 28 might plot almost a half of a circle while holding buffer layer 29 within the inwardly folded panel fabric layer 28, the surrounding of the buffer layer 29 can be protected, the end of the top layer 27, a region of the folded part of the panel fabric layer 28 and the buffer layer 29 can be prevented from being peeled from the fabric layer 12, even if the region is subjected with an impact load from the outside. Please note that the panel fabric layer 28 is folded inwardly in such a manner that the end of the panel fabric layer 28 can plot almost a quarter of a circle in the same manner as the top layer 27, if the material having withstand tear is employed for the buffer layer 29. The panel fabric layer 28 can be made of non-woven fabric instead of woven fabric. The panel fabric layer 28 reinforces the leather panels 25, 26, whereas the buffer layer 29 absorbs and reduces impact. In addition, these layers 28, 29 serve as a thickness adjusting portion, which maintains a uniform thickness of the leather panels 25, 26. The edge portions of the leather panels 25, 26 can be bonded together by adhesive. Thereby, the edge portions of adjoining panels can be completely contacted with each other, any aperture can be prevented from generating between both panels, and water can be prevented from penetrating between adjoining panels. With the above arrangement, the bonded edge portion between the leather panels 25, 26 has an arcuate section, providing a groove similar to a steep groove provided in a sewn ball having a skin layer made by sewing. The sewn-ball style groove improves flying distance, grip of the ball and so on. Alternatively, these leather panels 25, 26 having such an arcuate section as described above may be replaced by leather panels commonly used in a conventional laminated ball having a skin layer made by bonding. Specifically, a lower surface perimeter portion of each of the pentagonal and hexagonal panels is cut diagonally so that the bonded edges of the leather panel form a shallow V-shaped groove. Although the overlapped portion of the first and second fabric pieces 13, 14 of the fabric layer 12 becomes slightly thicker, this thickness a difference is absorbed by the buffer layer 29, and therefore will not appear in the leather panel surface. Alternatively, the panel fabric layer 28 and the buffer layer 29 may have a different arrangement. Specifically, a plurality of the woven panel fabric layers 28 may be laminated, or a plurality of the woven panel fabric layers 28 and the buffer layers 29 may be laminated for example.

The buffer layer 29 can be made of a foam material selected from a group consisting of CR, polyurethane, EPDM, polyethylene foam, EVA foam. By adjusting the buffer layer, bouncing height of the ball can be adjusted.

Embodiment 2

Figure 9:
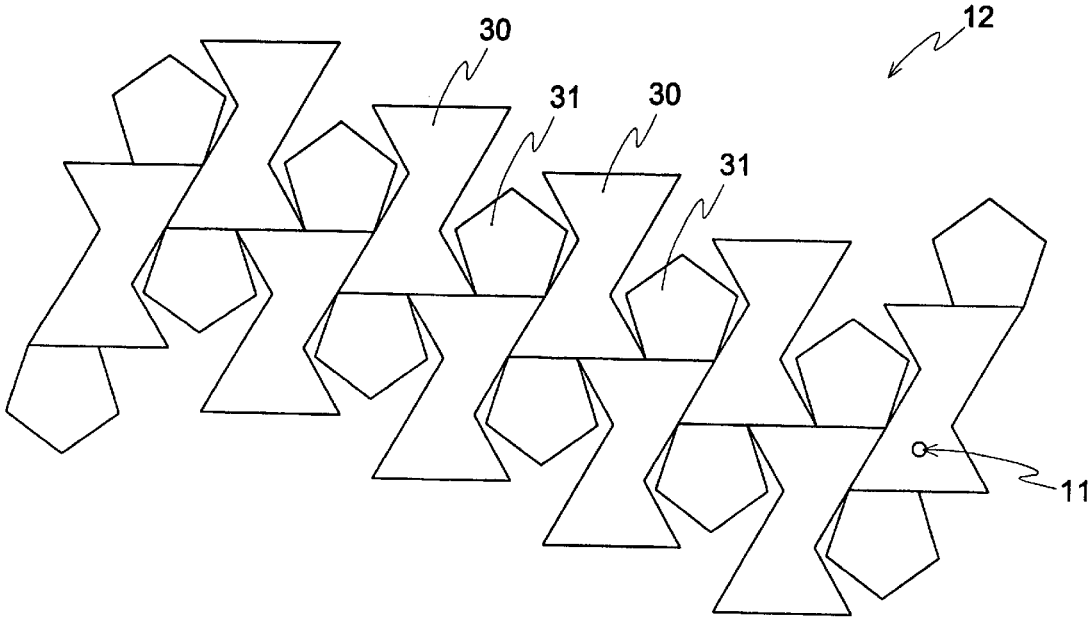
FIG. 9 is a plan view illustrating the arrangement of the fabric pieces in the fabric layer of the ball of the EMBODIMENT 2 of the present invention.
Figure 10:
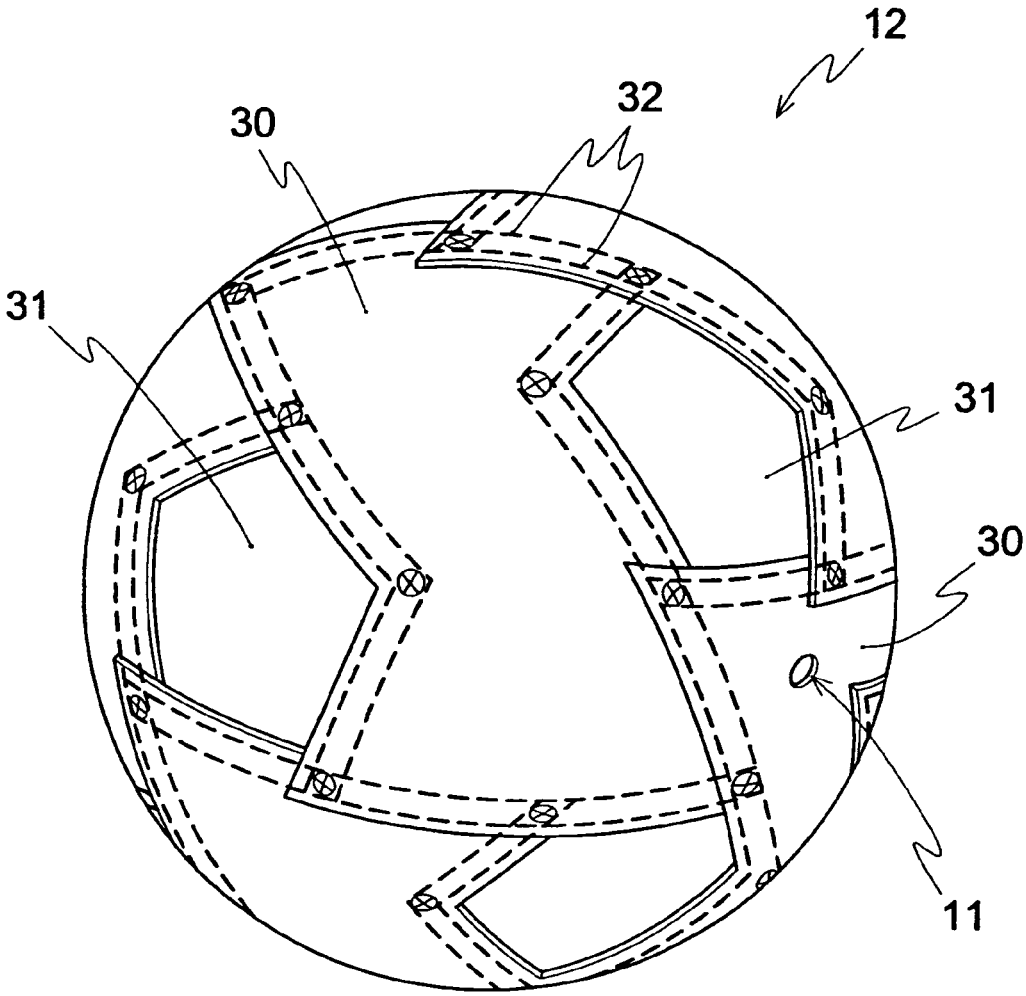
FIG. 10 is a front view showing the fabric layers spherically sewn together in the ball of the EMBODIMENT 2 of the present invention.

EMBODIMENT 2 of the present invention will be explained as mentioned hereinafter. As shown in FIGS. 9 and 10, the fabric layer is deformed in such a manner that spherical shape is formed by sewing ten pieces of a first fabric piece 30 together with twelve pieces of a second fabric piece 31, the second fabric pieces having a pentagonal shape. The first fabric piece 30 is composed of two triangles, one side of one of the two triangles is partially contacted with one side of the other one of the two triangles. In the example shown in FIGS. 9 and 10, length of each side of the triangle can be twice as long as that of the pentagon. Please note that the proportion of the length of each side of the triangle to that of the pentagon can be arbitrarily changed. Numeral 11 shows a valve hole formed in the center of one of the two triangles of the first fabric piece 30.

Each of the first and the second fabric pieces 30, 31 is laminated in such a manner that two sheets of woven fabric are superimposed and bonded to each other with latex adhesive, and the warp direction of one of the two sheets of woven fabric is perpendicular to that of the other one of the two sheets of woven fabric. The marginal edge of one of the first fabric pieces 30 is superimposed in the spherical surface direction with the marginal edge of one of the second fabric pieces 31, and corner portion of the superimposed marginal edges are temporary attached in substantially the same way as the EMBODIMENT 1. Thereafter, the superimposed marginal edges are sewn together by a sewing machine. Numeral 32 shows a sewing line. The method of achieving the sewn structure of the EMBODIMENT 1 can be applied to the EMBODIMENT 2. The bladder is introduced inside the spherically deformed fabric layer from the portion where the fabric pieces are partially not sewn. The spherically deformed fabric layer is subjected to finish sewing to be close the aperture. Further, the fabric layer 12 is covered with leather panels so that the ball of the EMBODIMENT 2 is completed.

Figure 11:
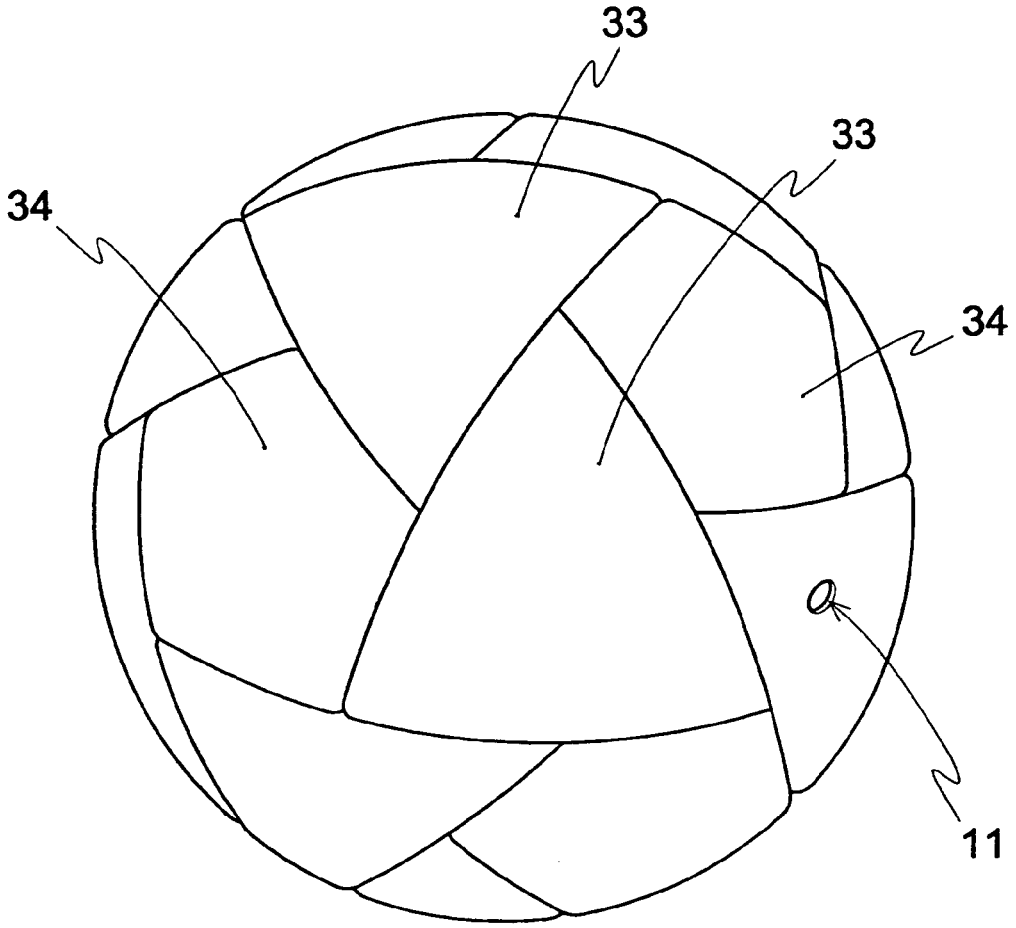
FIG. 11 is a front view showing the outline of the ball of the EMBODIMENT 2 of the present invention.

FIG. 11 shows an outline of the ball (soccer ball) comprising twenty pieces of right triangular leather panels 33 and twelve pieces of right pentagonal leather panels 34, the shape of which are accorded with right triangle of the first fabric piece 30 and right pentagon of the second fabric piece 31. The leather panels each of which has the same shape as the fabric pieces of the fabric layer, are arranged such that they are aligned with the first and second fabric pieces 30, 31.

Embodiment 3

Figure 12A:
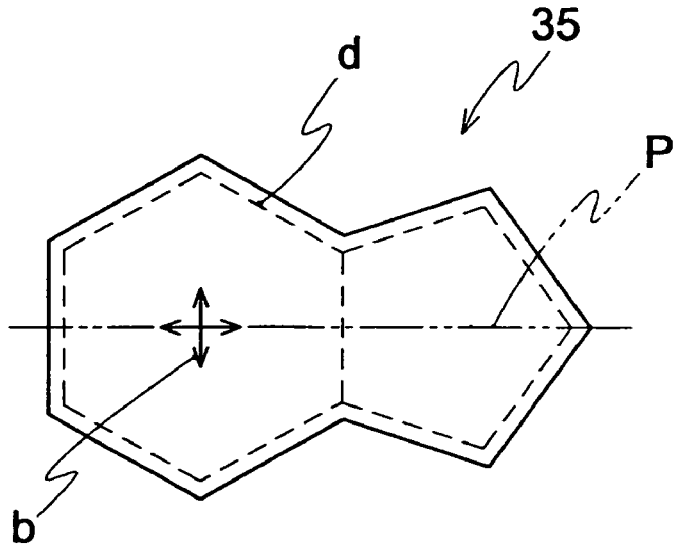
FIG. 12 is plan view showing a ball of the EMBODIMENT 3 of the present invention.
Figure 12B:
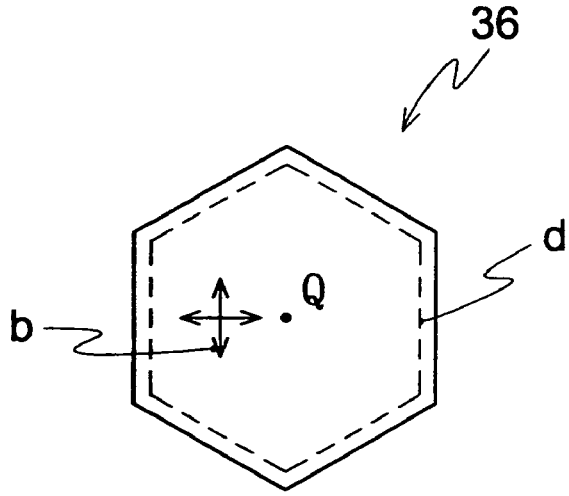
Figure 13:
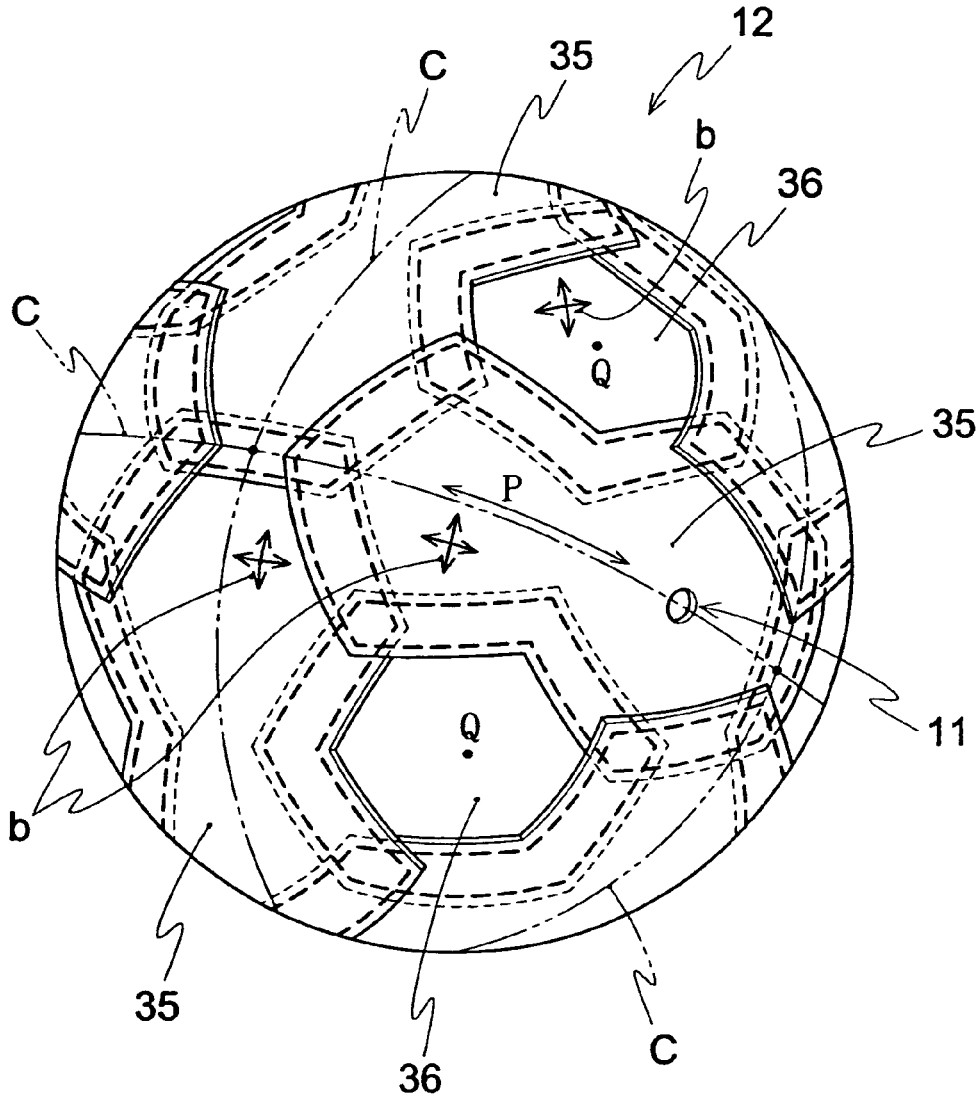
FIG. 13 is a front view showing the fabric layers spherically sewn together in the ball of the EMBODIMENT 3 of the present invention.
Figure 14:
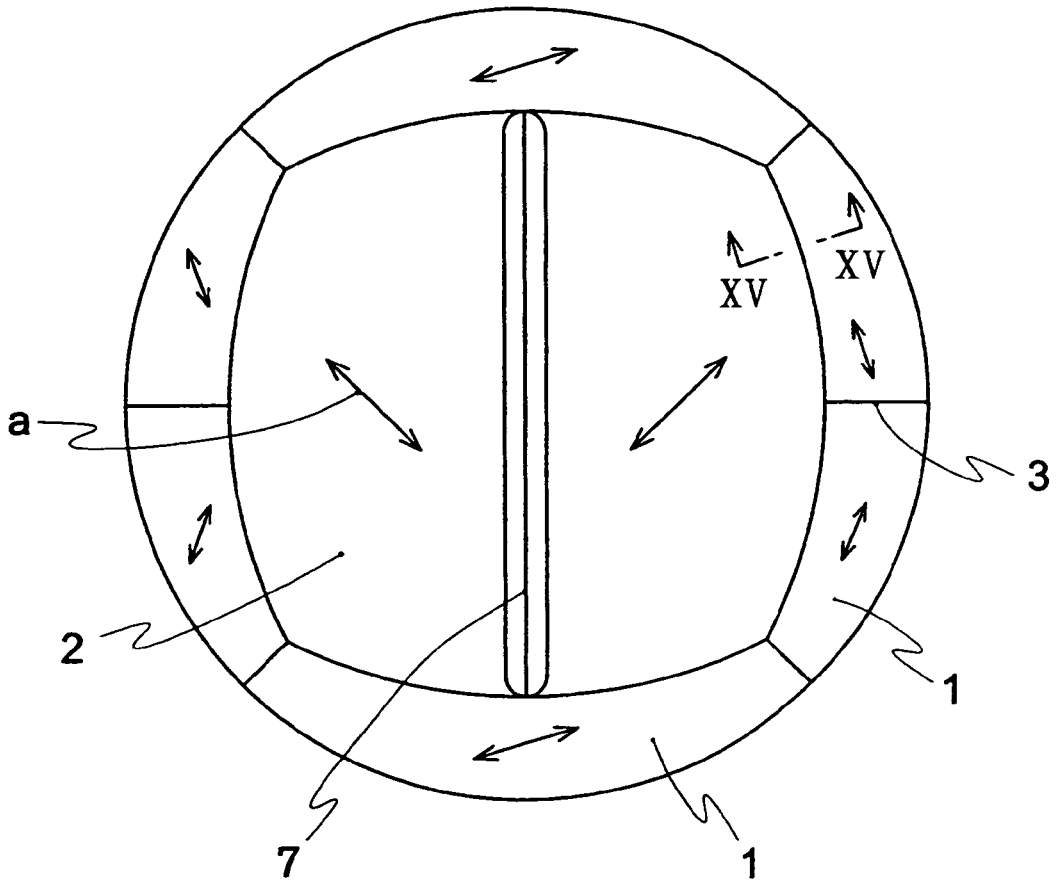
FIG. 14 is front view showing a conventional reinforcing layer.
Figure 15:
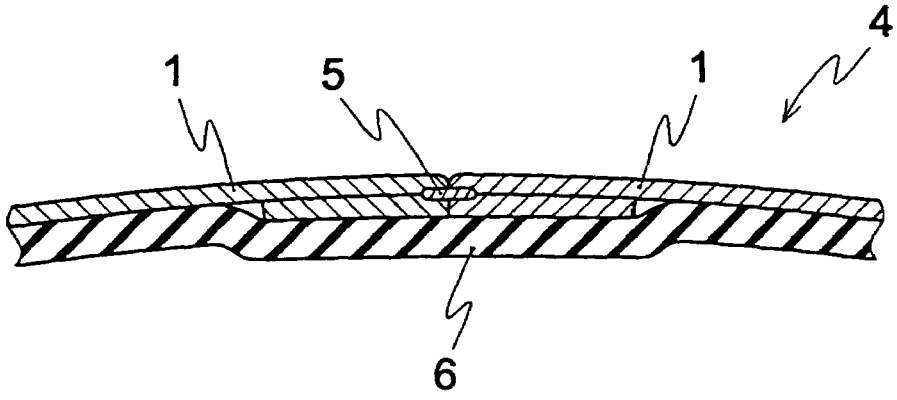
FIG. 15 is a cross sectional view taken along line XV—XV of FIG. 14.

EMBODIMENT 3 of the present invention will be explained hereinafter. In FIGS. 12 and 13, a fabric layer 12 is composed of twelve pieces of a first fabric piece 35 and eight pieces of a right hexagonal second fabric piece 36. The first fabric piece 35 has a shape corresponding to a right pentagon connected to a right hexagon. In the FIG. 12, the hexagonal parts and the pentagonal parts which correspond to semi-32hedral body are shown by dotted line d. The area lying outside the dotted line d is superimposed with adjacent fabric piece, and sewn together. The first fabric pieces 35 are arranged along three reference circles C, in such a manner that center line P and one of the warp or the weft line b of the first fabric piece are aligned with the reference circle C to cover substantially a quarter of a circle. The first fabric piece 35 has a shape which is symmetrical with the center line P. The seaming line positioned on one of the reference circles C (being the seam of two adjoining hexagonal parts of adjacent fabric pieces 35) is perpendicular to one of the other two reference circles C which in turn corresponds with the center lines of the two adjacent fabric pieces 35. Therefore, then the warp or the weft line and seaming line are continuously formed along the reference circle C. The second fabric piece 36 is positioned at the center of the triangular region formed by the reference circles C, that is the center Q of the second fabric piece 36 is aligned with the center of the triangular region formed by the reference circles C. The second fabric piece 36 is sewn together with the first fabric pieces 35 which are peripherally positioned.

On the fabric layer 12 constructed as mentioned above, there are arranged and bonded the hexagonal leather panel and the pentagonal leather panel respectively on the hexagonal part and pentagonal part of the fabric pieces, so that a ball of the EMBODIMENT 3 is completed. The outer skin of the ball of the EMBODIMENT 3 is the same as that shown in FIG. 7.

The shape of the fabric piece which meets the conditions as mentioned above is not limited to any combination of shapes comprising an adjacently joined, pentagon and hexagon, and hexagons of the EMBODIMENT 3 as mentioned above, but may include other combinations of various shapes easily made by any person skilled in the art.

According to the present invention, the fabric pieces are sewn together under the condition where the fabric pieces are superimposed and tensile strength of the fabric pieces are constantly maintained by a sewing machine. Therefore, a ball having high sphericity and even strength can be attained without causing any personal error. For that reason, sphericity, property for maintaining the desired shape, durability can be improved.

According to one embodiment of he invention, semi-32hedral can be constructed, and each surface is curved outwards, so that a high sphericity can be obtained by the leather panels of the surface layer as each panel is deformed spherically by inner pressure in the bladder.

According to one embodiment of the invention, semi-32hedral having substantially spherical body can be constructed. Therefore, the leather panels of the surface layer constituting each surface is deformed spherically by inner pressure in the bladder, and high sphericity can be obtained.

Generally speaking, the tensile strength in the warp direction is larger than that in weft direction. However, according to one embodiment of the invention, the fabric layer is formed of a laminate of two woven fabrics arranged such that the warp of the one fabric is perpendicular to that of the other. Therefore, the tensile strength of the fabric piece in the warp direction is substantially the same as that in the weft direction by superimposing two fabric pieces, so that sphericity of the ball is improved and the desired shape of a ball is maintained.

According to one embodiment of the invention, the positioning of the joined portion in the fabric layer corresponds, or substantially corresponds with the positioning of the joined portion of the panels in the outer skin layer. With the above arrangement, the joined portion of the panels in the outer skin layer is positioned on the seaming line of the two fabric pieces having a greater bonding strength. Therefore, any aperture cannot appear between any one of the panels and the other one of the panels adjacent thereto, and close contact of adjacent two panels can be maintained.

According to one embodiment of the invention, the pressure applied to the fabric layer from the bladder or the impact load applied from the outside is evenly dispersed throughout the fabric layer, and the sphericity is maintained even if the pressure is iteratively applied to the fabric layer for a long interval.

According to one embodiment of the invention, the plurality of the fabric pieces are superimposed in parallel, and adjacent fabric pieces are accurately aligned by temporary attachment, so as to be finally sewn together by a sewing machine. Therefore, the sphericity having high accuracy can be attained, sewing work can be easily made. Because, in such a case that the fabric pieces are not temporarily attached to each other, the position for arranging the fabric pieces is not decided. Accordingly, the fabric pieces are sewn together at the same time as aligning them. Further, in the case of a spherical shape like fabric layer, sewing work is very difficult, and high accuracy cannot be attained. Thus, according to the method, the marginal edge of the fabric pieces are superimposed in the direction of spherical surface, and it is not necessary to be folded inside, so that sewing work will not become more and more difficult as the number of the fabric pieces sewn together increases.

According to one embodiment of the invention, the fabric pieces are sewn along the guiding line by the worker, so that the fabric pieces can be, accurately and easily sewn together.

According to one embodiment of the invention, the fabric pieces are sewn together in such a manner that two lines parallel to each other are formed. With the above arrangement, two fabric pieces sewn together have tensile strength twice as much as the fabric pieces which are sewn together in such a manner that a single sewing line is formed. On the other hand, according to the conventional construction where the fabric piece is folded inside after sewing the fabric pieces together, strength obtained by one of the seaming lines (the seaming line positioned on the inner side of the leather panel), to which tensile strength is applied, is limited. Therefore, in the conventional ball, strength cannot be improved even if number of the thread used is increased. On the other hand, in the present invention the strength will be increased as the number of the thread for sewing.

According to one embodiment of the invention, the fabric pieces are bonded together by applying latex adhesive, the temporary attachment is undergone by melting latex adhesive using ultrasonic wave. Therefore, marginal edges of two fabric pieces are superimposed and partially subjected to ultrasonic wave. Thereby, latex adhesive is heated and melted to be welded, so that temporary attachment between fabric pieces can be instantly attained.

According to one embodiment of the invention, in the case of finish sewing, after inserting the bladder inside of the spherically deformed fabric layer, bladder insertion aperture is sewn up by using the needle through hole. Therefore, the property such as restitution in the part subjected to finish sewing can be the same property required for the other part to be sewn.

According to one embodiment of the invention, the needle through hole may be an opening for a valve for injection of the air into the bladder. Therefore, there is no particular need for providing a hole specifically for the finish sewing. For that reason, decreasing of strength, changing of property such as restitution which are expected to arise in the case of independently forming the needle through hole, can be prevented from generating.

INDUSTRIAL APPLICABILITY

According to the present invention, the fabric pieces are sewn together under the condition where the fabric pieces are superimposed and tensile strength of the fabric pieces are constantly maintained by a sewing machine. Therefore, a ball having high sphericity and even strength can be attained without causing any personal error. For that reason, sphericity, property for maintaining the desired shape, durability can be improved.

What is claimed is:

1. Ball for ball game comprising:

a bladder;

a fabric layer around the bladder; and an outer skin layer made of a plurality of panels; wherein the fabric layer is formed of fabric pieces whose marginal edges are superimposed, and sewn together with a substantially radially disposed thread, wherein a position of a joined portion of the fabric pieces in the fabric layer at least substantially corresponds with a position of a joined portion of the panels in the outer skin layer.

2. A ball for ball game as in claim 1, wherein the fabric pieces comprise a shape selected from the group consisting of a pentagon, a hexagon, and combinations thereof.

3. A ball for ball game as in claim 1, wherein the fabric pieces comprise a shape selected from the group consisting of a triangle, a pentagon, and combinations thereof.

4. A ball for ball game as in claim 1, wherein the fabric layer is formed of a laminate of two woven fabrics arranged such that respective warps of the two woven fabrics are perpendicular.

5. A ball for ball game comprising:

a bladder;

a fabric layer around the bladder; and an outer skin layer made of a plurality of panels; wherein the fabric layer is formed of fabric pieces whose marginal edges are superimposed, and sewn together with a substantially radially disposed thread, wherein a shape of the fabric pieces in the fabric layer is at least substantially similar to a shape of at least one of the plurality of panels of the outer skin layer.

6. A ball for ball game as in claim 1, wherein at least one of the fabric pieces has a center line and at least one of a warp line and a weft line which corresponds with one of three reference circles on a spherical surface of the fabric layer, any one of the three reference circles being perpendicular to the other two reference circles.

7. A ball for ball game as in claim 6, wherein the fabric layer includes a first fabric piece arranged in such a manner that at least one of the warp line and the weft line is formed along one of the three reference circles and a second fabric piece arranged in the center of a triangular region formed by the three reference circles.

8. A method for manufacturing a ball comprising the steps of:

providing a bladder;

forming a fabric layer around the bladder, wherein the fabric layer is formed by a plurality of fabric pieces whose marginal edges are superimposed;

forming an outer skin layer from a plurality of panels, wherein the fabric layer is further formed by first attaching the fabric pieces together by bonding to form a temporary attachment, and then sewing the fabric pieces together with a substantially radially disposed thread;

forming a spherical fabric layer by sewing the fabric pieces together by a sewing machine in such a manner as to allow an aperture not to be sewn together, the aperture serving as a hole for inserting the bladder;

forming a penetrating hole for inserting a needle through the fabric layer;

inserting the bladder into the spherical fabric layer; and thereafter closing the aperture for inserting the bladder by sewing the fabric layer via the penetrating hole using the sewing machine.

9. A method as in claim 8, wherein the fabric pieces are sewn together along a guiding line for sewing formed on the fabric pieces by printing.

10. A method as in claim 8, wherein the fabric pieces are sewn together to form two parallel sewing lines.

11. A method as in claim 8, wherein the fabric pieces are bonded together by applying a latex adhesive and the temporary attachment is created by melting the latex adhesive using an ultrasonic wave.

12. A method as in claim 8, wherein the penetrating hole for inserting a needle serves as a hole for a valve allowing compressed air to be introduced into the bladder.

13. A ball for a ball game manufactured in accordance with the method of claim 8.

14. A ball for ball game as in claim 5, wherein the fabric pieces comprise a shape selected from the group consisting of a pentagon, a hexagon, and combinations thereof.

15. A ball for ball game as in claim 5, wherein the fabric pieces comprise a shape selected from the group consisting of a triangle, a pentagon, and combinations thereof.

16. A ball for ball game as in claim 5, wherein the fabric layer is formed of a laminate of two woven fabrics arranged such that respective warps of the two woven fabrics are perpendicular.

17. A ball for ball game as in claim 5, wherein at least one of the fabric pieces has a center line and at least one of a warp line and a weft line which corresponds with one of three reference circles on a spherical surface of the fabric layer, any one of the three reference circles being perpendicular to the other two reference circles.

18. A ball for ball game as in claim 17, wherein the fabric layer includes a first fabric piece arranged in such a manner that at least one of the warp line and the weft line is formed along one of the three reference circles and a second fabric piece arranged in the center of a triangular region formed by the three reference circles.

* * * * *